US007088295B2

(12) United States Patent
Komatsu et al.

(10) Patent No.: US 7,088,295 B2
(45) Date of Patent: Aug. 8, 2006

(54) VEHICLE-MOUNTED ANTENNA

(75) Inventors: Satoru Komatsu, Tokyo (JP); Tomoyuki Fukumaru, Kawachi-gun (JP); Hiroshi Kuribayashi, Higashimatsuyama (JP); Hiroshi Iijima, Moriya (JP); Hideaki Oshima, Toride (JP); Tatsuo Matsushita, Inashiki-gun (JP)

(73) Assignees: Honda Motor Co., Ltd., Tokyo (JP); Nippon Sheet Glass Co., Ltd., Tokyo (JP)

( * ) Notice: Subject to any disclaimer, the term of this patent is extended or adjusted under 35 U.S.C. 154(b) by 61 days.

(21) Appl. No.: 10/876,757

(22) Filed: Jun. 28, 2004

(65) Prior Publication Data

US 2005/0007284 A1 Jan. 13, 2005

(30) Foreign Application Priority Data

Jun. 30, 2003 (JP) ..... P2003-187303

(51) Int. Cl.
*H01Q 1/32* (2006.01)

(52) U.S. Cl. ..... 343/713; 343/767; 343/846

(58) Field of Classification Search ..... 343/713, 343/712–714, 767, 846
See application file for complete search history.

(56) References Cited

U.S. PATENT DOCUMENTS

| | | | | |
|---|---|---|---|---|
| 6,188,369 | B1 | 2/2001 | Okabe et al. | 343/767 |
| 6,195,048 | B1 * | 2/2001 | Chiba et al. | 343/700 MS |
| 6,342,864 | B1 | 1/2002 | Muramoto et al. | 343/770 |
| 6,404,394 | B1 | 6/2002 | Hill | 343/702 |
| 6,870,504 | B1 * | 3/2005 | Ikegaya et al. | 343/700 MS |
| 6,937,198 | B1 * | 8/2005 | Iijima et al. | 343/713 |
| 6,940,460 | B1 * | 9/2005 | Maoz et al. | 343/702 |
| 2002/0140607 | A1 * | 10/2002 | Zhou | 343/700 MS |
| 2002/0175864 | A1 | 11/2002 | Fang et al. | 343/702 |
| 2003/0043083 | A1 | 3/2003 | Huang | 343/767 |
| 2003/0184485 | A1 * | 10/2003 | Jiang et al. | 343/767 |

FOREIGN PATENT DOCUMENTS

| | | |
|---|---|---|
| EP | 0 378 905 A1 | 7/1990 |
| EP | 1 128 467 A2 | 8/2001 |
| JP | 05-063424 | 3/1993 |
| JP | 2002-252520 | 9/2002 |

* cited by examiner

*Primary Examiner*—Hoang V. Nguyen
*Assistant Examiner*—Huedung X. Cao
(74) *Attorney, Agent, or Firm*—Arent Fox PLLC

(57) ABSTRACT

A vehicle-mounted antenna of the present invention includes a grounding conductor arranged on a vehicle interior side surface of a rear window that inclines at a predetermined inclination angle with respect to the horizontal plane, a slot and a U-shaped auxiliary slot formed in the grounding conductor, and an electrically conductive reflecting plate that protrudes in a direction that forms a predetermined angle with respect to the surface of the grounding conductor so as to slope downward towards the front of the vehicle from a location shifted downward in the vertical direction (front of the vehicle) from the slot on the surface of the grounding conductor at a location close to the slot.

4 Claims, 8 Drawing Sheets

(WITH ELECTRICALLY CONDUCTIVE REFLECTING PLATE)

(WITHOUT ELECTRICALLY CONDUCTIVE REFLECTING PLATE)

(WITH ELECTRICALLY CONDUCTIVE REFLECTING PLATE)

(WITH ELECTRICALLY CONDUCTIVE REFLECTING PLATE AND SECOND CONDUCTOR SECTION)

VEHICLE-MOUNTED ANTENNA

BACKGROUND OF THE INVENTION

Priority is claimed on Japanese Patent Application No. 2003-187303, filed Jun. 30, 2003, the content of which is incorporated herein by reference.

1. Field of the Invention

The present invention relates to a vehicle-mounted antenna composed of a slot antenna.

2. Description of Related Art

A planar antenna is known in the prior art, for example, that is equipped with a radiating conductor provided on the same surface on the interior side of a vehicle window glass and a roughly loop-shaped grounding conductor that surrounds the periphery of the edge of the radiating conductor at a location away towards the outside from the outer edge of the radiating conductor (see, for example, Japanese Unexamined Patent Application, First Publication No. 2002-252520).

In addition, a planar antenna is known that is equipped with a spacer that inclines the antenna so that the normal direction of the planar antenna approaches the vertical more than the normal direction of the mounting position of the planar antenna (e.g., vehicle window glass) in order to improve the reception sensitivity with respect to signals received from an artificial satellite at a relatively high elevation angle (see, for example, Japanese Unexamined Patent Application, First Publication No. Hei 5-63424).

However, when mounting a planar antenna according to the aforementioned prior art into a vehicle, in the case of arranging on a vehicle window glass such as the front windshield or rear window, it is desirable to prevent the field of view of the vehicle passengers from being obstructed, and also to prevent the appearance of the vehicle from being impaired.

However, if the dimensions, arrangement and so forth of a planar antenna are restricted based on vehicle appearance and so forth, there is the risk of it being difficult to obtain the desired transmission and reception characteristics. In the case a planar antenna has been provided on the surface of a vehicle window glass arranged so as to intersect the vertical direction in particular, there is the problem of it being difficult to ensure the desired transmission and reception reliability with respect to vertically polarized waves arriving from the horizontal direction.

In consideration of the aforementioned circumstances, the object of the present invention is to provide a vehicle-mounted antenna capable of inhibiting the loss of installability onto a vehicle while improving transmission and reception characteristics with respect to vertically polarized waves arriving from the horizontal direction.

SUMMARY OF THE INVENTION

A vehicle-mounted antenna according to the present invention includes: a slot antenna equipped with a grounding conductor provided on the surface of a dielectric substrate and a slot formed in the grounding conductor that exposes the surface of the dielectric substrate, and a roughly plate-shaped electrically conductive reflecting member that protrudes from the surface of the grounding conductor at a location close to the slot and forms a predetermined angle with the surface of the grounding conductor.

According to this vehicle-mounted antenna, even in the case, for example, the dielectric substrate is made to be the window glass of a vehicle and has a surface that intersects the vertical direction, by providing the electrically conductive reflecting member that protrudes from the slot antenna formed on the surface of this dielectric substrate so as to form a predetermined angle with this surface, electric field strength can be relatively increased in a desired region due to the shielding effect of this electrically conductive reflecting member. Namely, as a result of providing the electrically conductive reflecting member, radiation characteristics of the slot antenna in the horizontal direction can be improved, and the sensitivity to vertically polarized waves arriving from the horizontal direction can be improved.

The grounding conductor may be composed of two conductor sections integrally formed with the location where the slot is formed serving as the border between them, the length of one conductor section in the lengthwise direction of the slot may be formed to be shorter than the length of the other conductor section, and the two conductor sections may be formed in mutually asymmetrical shapes bordering on the slot.

In this case, as a result of the grounding conductor being shaped in an asymmetrical shape with the position where the slot is formed in the grounding conductor of the slot antenna serving as a border section, in comparison with, for example, the case in which the grounding conductor is formed into a symmetrical shape, the directional characteristics with respect to vertically polarized waves arriving from the horizontal direction can be set to a shape that more closely approximates non-directivity.

In addition, a vehicle-mounted antenna according to the present invention includes: a slot antenna equipped with a grounding conductor provided on the surface of a dielectric substrate; and a slot formed in the grounding conductor, the slot exposing the surface of the dielectric substrate, wherein the grounding conductor is composed of two conductor sections integrally formed with the location where the slot is formed serving as the border between them, the length of one conductor section in the lengthwise direction of the slot is formed to be shorter than the length of the other conductor section, and the two conductor sections are formed into mutually asymmetrical shapes bordering on the slot.

According to this vehicle-mounted antenna, as a result of the grounding conductor being formed into an asymmetrical shape with the location where the slot is formed in the grounding conductor of the slot antenna serving as the border section, in comparison with the case, for example, in which the grounding conductor is formed into a symmetrical shape, the directional characteristics with respect to vertically polarized waves arriving from the horizontal direction can be set to a shape that more closely approaches non-directivity.

An auxiliary slot may be provided in the grounding conductor that exposes the surface of the dielectric substrate roughly in the shape of the letter "U", the slot may be connected to both ends of the auxiliary slot, and another conductor section may be formed in the grounding conductor of which the peripheries are surrounded by the slot and the auxiliary slot.

In this case, as a result for forming the auxiliary slot, impedance characteristics of the slot antenna can be improved as compared with, for example, the case of not providing the auxiliary slot, and reflection and waveguide characteristics can be improved with respect to vertically polarized waves arriving from the horizontal direction.

DETAILED DESCRIPTION OF THE INVENTION

The following provides an explanation of an embodiment of the vehicle-mounted antenna of the present invention with reference to the attached drawings.

Figure 1:
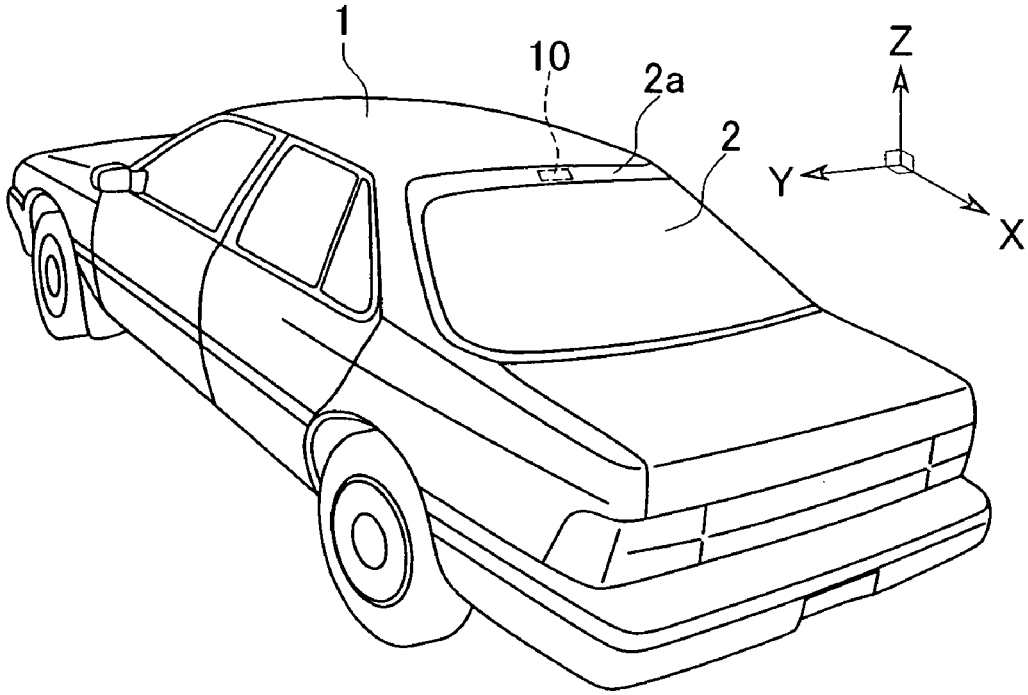
FIG. 1 is a perspective view of a vehicle loaded with a vehicle-mounted antenna according to a first embodiment of the present invention.
Figure 2:
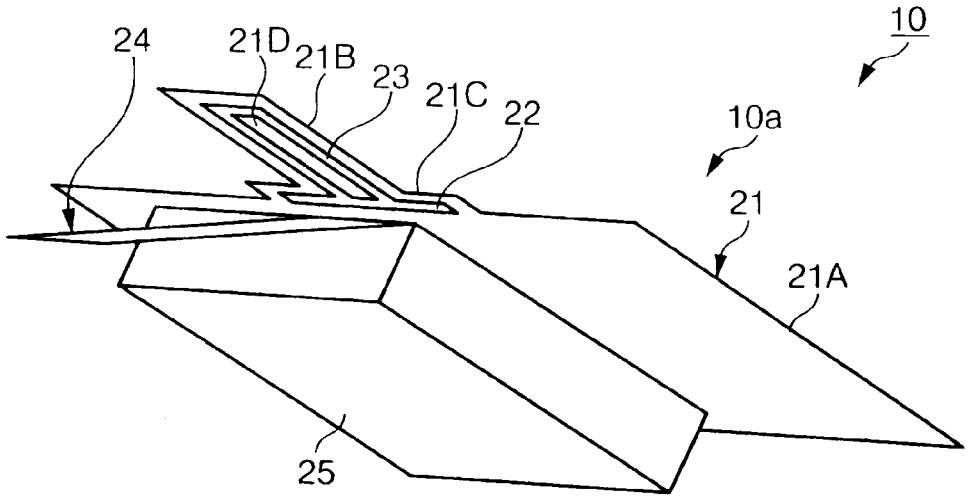
FIG. 2 is a perspective view of the vehicle-mounted antenna shown in FIG. 1.

As shown, for example, in FIG. 1, vehicle-mounted antenna 10 of the present embodiment is arranged on the interior side surface 2A of the periphery 2*a* of a rear window 2 of the window glasses in a vehicle 1.

This vehicle-mounted antenna 10 is, for example, an antenna that receives radio waves transmitted from a suitable base station and so forth, and particularly vertically polarized waves arriving from the horizontal direction.

As shown in FIGS. 2 through 5, for example, vehicle-mounted antenna 10 is composed by being provided with a slot antenna 10*a*, which is composed of a grounding conductor 21 including an electrically conductive thin film and so forth arranged on the interior side surface 2A of rear window 2 serving as a dielectric substrate and a slot 22 formed in grounding conductor 21, an auxiliary slot 23 formed in grounding conductor 21, and a roughly rectangular electrically conductive reflecting plate 24, which protrudes from the surface of grounding conductor 21 at a location close to slot 22 and forms a predetermined angle ϕ with the surface of grounding conductor 21.

Grounding conductor 21 is formed by a roughly rectangular first conductor section 21A and a second conductor section 21B composed of an electrically conductive thin film being integrally connected with the location at which a slot 22 to be described later is formed serving as the border between them. On vehicle interior side surface 2A, which is inclined at a roughly acute inclination angle θ downward in the vertical direction relative to horizontal plane H so as to have a downward slope towards the rear of the vehicle, for example, second conductor section 21B is arranged on the upper side in the vertical direction while first conductor section 21A is arranged on the lower side in the vertical direction.

In the lengthwise direction (for example, direction Y shown in FIG. 5) of slot 22 to be described later, for example, length LB of second conductor section 21B is formed to be shorter than length LA of first conductor section 21A (LA>LB), and first conductor section 21A and second conductor section 21B are formed mutually asymmetrically bordering on slot 22.

In addition, center line PA of first conductor section 21A, which is perpendicular to the lengthwise direction of slot 22 and contains the center position of first conductor 21A, and center line PB of second conductor section 21B, which is perpendicular to the lengthwise direction of slot 22 and contains the center position of second conductor section 21B, are formed to be aligned, and first conductor section 21A and second conductor section 21B are, for example, formed in a linearly symmetrical shape with respect to each center line PA and PB.

In addition, a roughly rectangular border conductor section 21C is formed in first conductor 21A at the border between first conductor section 21A and second conductor section 21B, length LC of border conductor section 21C in the lengthwise direction of slot 22 is, for example, formed to be longer than length LB of second conductor section 21B and shorter than length LA of first conductor section 21A (LA>LC>LB), and center line PC of border conductor section 21C, which is perpendicular to the lengthwise direction of slot 22 and contains the center position of border conductor section 21C, and center line PA of first conductor section 21A are formed to be aligned.

Figure 6:
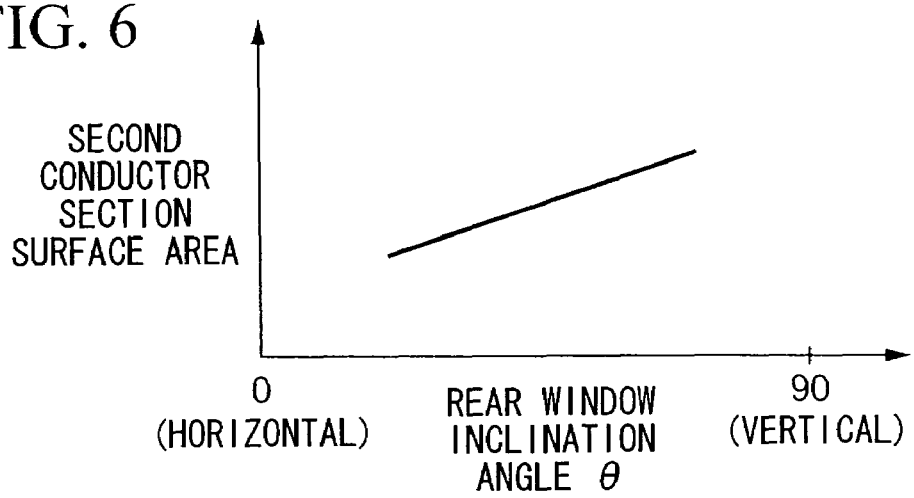
FIG. 6 is a graph showing one example of the change in surface area of a second conductor section versus the inclination angle θ of the rear window of the same vehicle-mounted antenna.

In addition, for example, the surface area of second conductor section 21B, which is set by length LB of second conductor section 21B in the lengthwise direction of slot 22 and length VB of second conductor section 21B in the direction perpendicular to the lengthwise direction of slot 22 (e.g., LB×VB), is set to change in an increasing trend corresponding to an increase in inclination angle θ relative to horizontal plane H of vehicle interior side surface 2A of rear window 2 (namely, inclination angle θ of the surface of grounding conductor 21 relative to horizontal plane H) as shown in, for example, FIG. 6.

Slot 22 is composed of a roughly rectangular through hole formed in grounding conductor 21 at the border between first conductor section 21A and second conductor section 21B, and vehicle interior side surface 2A of rear window 2 is exposed through this slot 22.

An auxiliary slot 23 is composed of a roughly U-shaped through hole formed in second conductor section 21B, and vehicle interior side surface 2A of rear window 2 is exposed through this auxiliary slot 23, and two ends of auxiliary slot 23 are connected to slot 22.

Namely, conductor section 21D is formed in second conductor section 21B, the periphery of which is surrounded by slot 22 and auxiliary slot 23.

Length SB of auxiliary slot 23 in the lengthwise direction of slot 22 (e.g., direction Y shown in FIG. 5) is formed, for example, to be shorter than length LB of second conductor section 21B (LB>SB).

Figure 3:
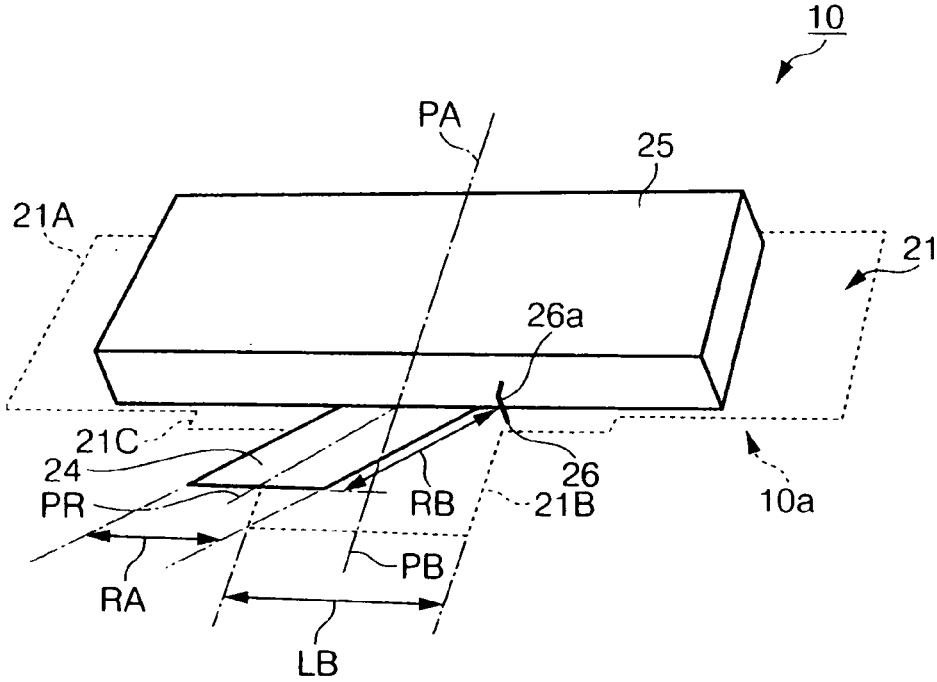
FIG. 3 is a perspective view of the same vehicle-mounted antenna.
Figure 5:
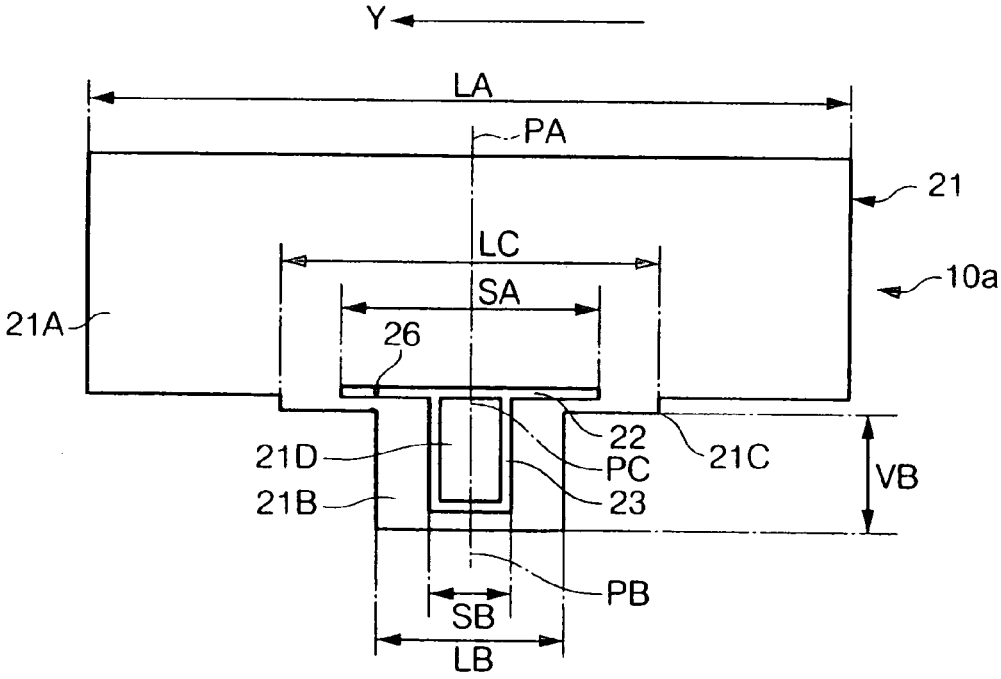
FIG. 5 is a plan view of a grounding conductor of the same vehicle-mounted antenna.

In addition, as shown, for example, in FIG. 5, a power supply point 26 is provided in slot 22 at a location shifted from the center position in the lengthwise direction of slot 22 corresponding to impedance matching and so forth, and as shown, for example, in FIG. 3, this power supply point 26 is connected to, for example, an amplification circuit 25 arranged on the surface of first conductor section 21A via a suitable power supply line 26*a*, and this amplification circuit 25 is connected, for example, to a transmitter or receiver (not shown).

Figure 4:
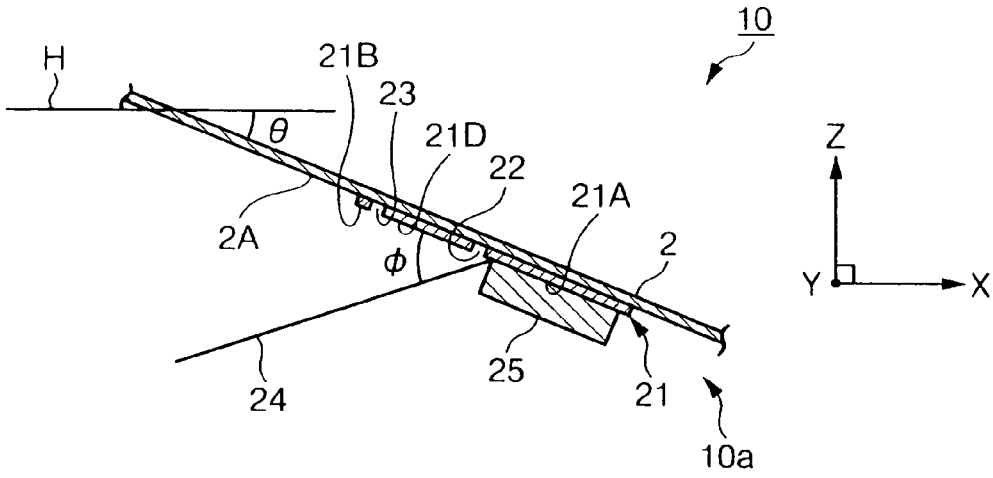
FIG. 4 is a cross-sectional view of the same vehicle-mounted antenna.

As shown, for example, in FIG. 4, electrically conductive reflecting plate 24 is arranged so as to protrude in a direction that forms a predetermined angle $\phi$ with respect to the surface of grounding conductor 21 so as to have a downward slope towards the front of the vehicle from a location shifted downward in the vertical direction (in other words, towards the rear of the vehicle) from slot 22 on the surface of grounding conductor 21.

Namely, center line PR of electrically conductive reflecting plate 24, which is perpendicular to the lengthwise direction of slot 22 and contains the center position of electrically conductive reflecting plate 24, intersects with any of the directions in which each center line PA, PB and PC of each conductor section 21A, 21B and 21C extends that faces upward in the vertical direction (in other words, towards the front of the vehicle) at a predetermined angle $\phi$, and this predetermined angle $\phi$ is set to be larger than, for example, inclination angle $\theta$ of the surface of grounding conductor 21 with respect to horizontal plane H.

Figure 7A:
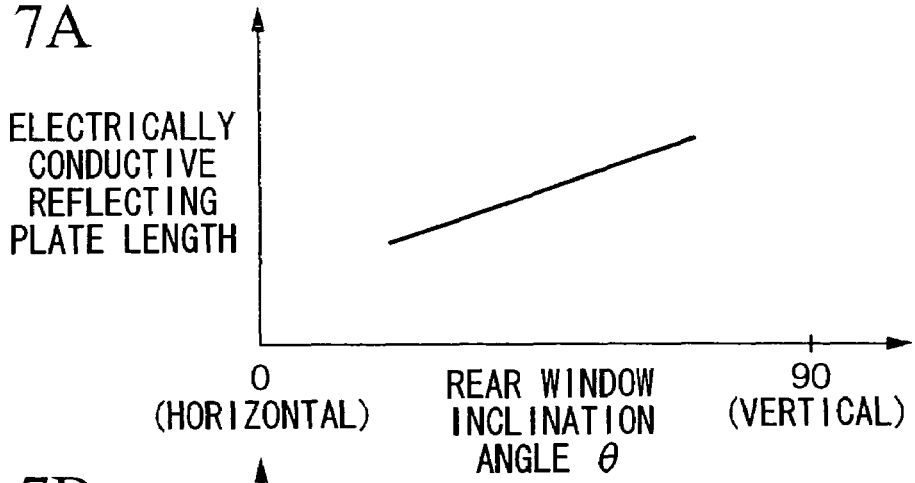
FIG. 7A is a graph showing one example of the change in surface area of an electrically conductive reflecting plate versus the inclination angle θ of the surface of a grounding conductor relative to horizontal plane H of the same vehicle-mounted antenna.

As shown, for example, in FIG. 7, length RB of electrically conductive reflecting plate 24 in the direction perpendicular to the lengthwise direction of slot 22 is set so as to change in an increasing trend corresponding to an increase in inclination angle $\theta$ of the surface of grounding conductor 21 with respect to horizontal plane H.

In the state in which a desired transmission and reception sensitivity has been secured with respect to vertically polarized waves to be described later, length RB of electrically conductive reflecting plate 24 in the direction perpendicular to the lengthwise direction of slot 22 is set to a suitable dimension of about $\lambda/4$ or less.

Figure 7B:
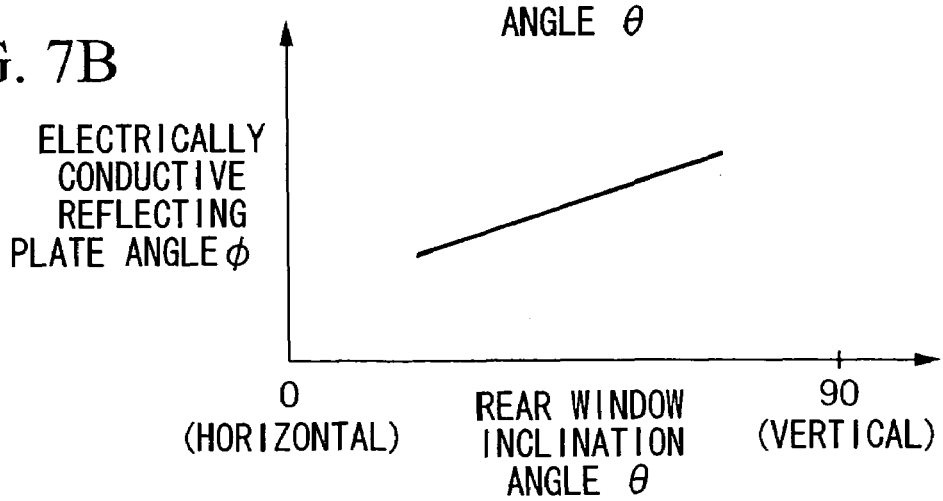
FIG. 7B is a graph showing one example of a change in a predetermined angle ϕ formed between an electrically conductive reflector plate and the surface of a grounding conductor versus the inclination angle θ of the surface of the grounding conductor relative to horizontal plane H of the same vehicle-mounted antenna.

In addition, as shown, for example, in FIG. 7B, the angle formed between electrically conductive reflecting plate 24 and grounding conductor 21, namely predetermined angle $\phi$, is set to as to change in an increasing trend corresponding to an increase in inclination angle $\theta$ of the surface of grounding conductor 21 with respect to horizontal plane H.

The vehicle-mounted antenna 10 according to the present embodiment is provided with the aforementioned constitution, and the following provides an explanation of the operating characteristics of this vehicle-mounted antenna 10 with reference to the attached drawings.

The following provides an explanation of the electric field distribution of vehicle-mounted antenna 10.

Figure 8A:
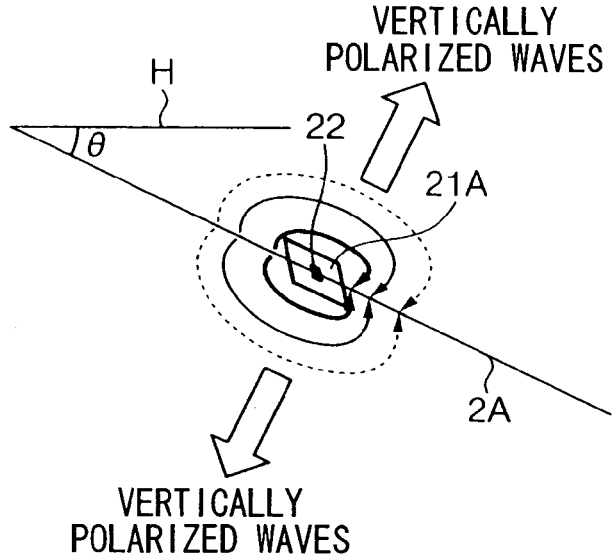
FIG. 8A is a graph showing one example of the electric field distribution in the case in which the second conductor section and electrically conductive reflecting plate of the same vehicle-mounted antenna, are omitted.

As shown, for example, in FIG. 8A, in the state in which slot 22 is formed in first conductor section 21 a inclined at a predetermined inclination angle $\theta$ with respect to horizontal plane H, an electric field occurs so as to be planar symmetrical with respect to the surface of first conductor section 21A, and transmission and reception sensitivity with respect to vertically polarized wave components propagating in the direction perpendicular to the surface of first conductor section 21A increases. Consequently, in the case, for example, inclination angle $\theta$ is small, there are cases in which it is not possible to secure the desired transmission and reception sensitivity with respect to vertically polarized wave components propagating from the horizontal direction.

Figure 8B:
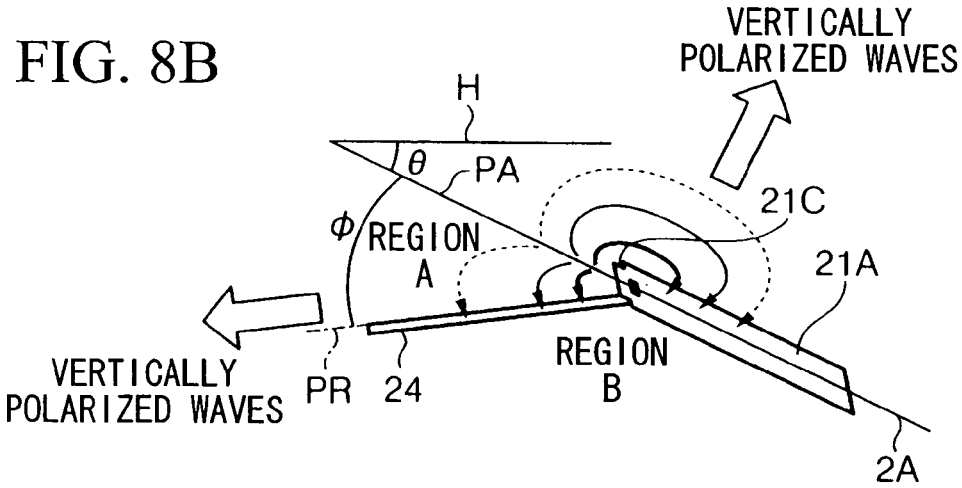
FIG. 8B is a graph showing one example of the electric field distribution in the case in which the electrically conductive reflecting plate of the same vehicle-mounted antenna are omitted.

In contrast, as shown, for example, in FIG. 8B, if electrically conductive reflecting plate 24 is made to protrude from a location shifted downward in the vertical direction (namely, towards the rear of the vehicle) from slot 22 on the surface of first conductor section 21A so as to form a predetermined angle $\phi$ with respect to the direction extending upward in the vertical direction (namely, towards the front of the vehicle) of center line PA of first conductor section 21A and have a downward slope towards the front of the vehicle, transmission and reception sensitivity with respect to vertically polarized wave components propagating in the horizontal direction can be improved.

Figure 9A:
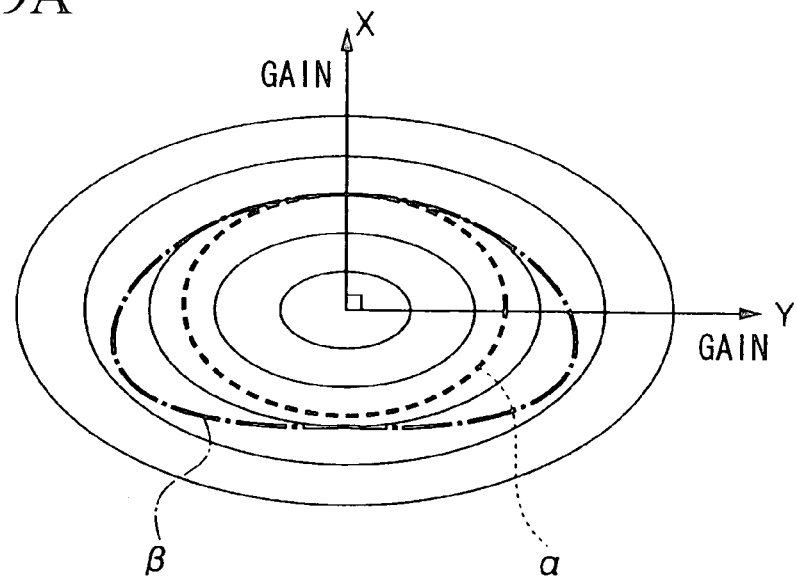
FIG. 9A is a graph showing one example of the directional characteristics with respect to vertically polarized waves in the horizontal plane between the vehicle-mounted antenna shown in FIG. 8A and the vehicle-mounted antenna shown in FIG. 8B.

Namely, due to the shielding effects of electrically conductive reflecting plate 24, the strength of the electric field of region B, in which the angle formed by electrically conductive reflecting plate 24 and first conductor section 21A is a supplementary angle ($\pi-\phi$) of predetermined angle $\phi$, is relatively weakened, while the strength of the electric field of region A, in which the angle formed by electrically conductive reflecting member 24 and first conductor section 21A is predetermined angle $\phi$, is relatively strengthened. As a result, as shown, for example, in FIG. 9A, during a change in the directional characteristics with respect to vertically polarized wave components within the horizontal plane (within the XY plane shown in FIG. 1), namely a change in the sensitivity (gain) with respect to vertically polarized wave components about the vertical axis (Z axis shown in FIG. 1), the direction characteristics $\beta$ in the case of being provided with electrically conductive reflecting plate 24 are such that the gain in the forward direction of the vehicle in which electrically conductive reflecting plate 24 protrudes increases as compared with the directional characteristics $\alpha$ in the case of omitting electrically conductive reflecting plate 24.

Figure 8C:
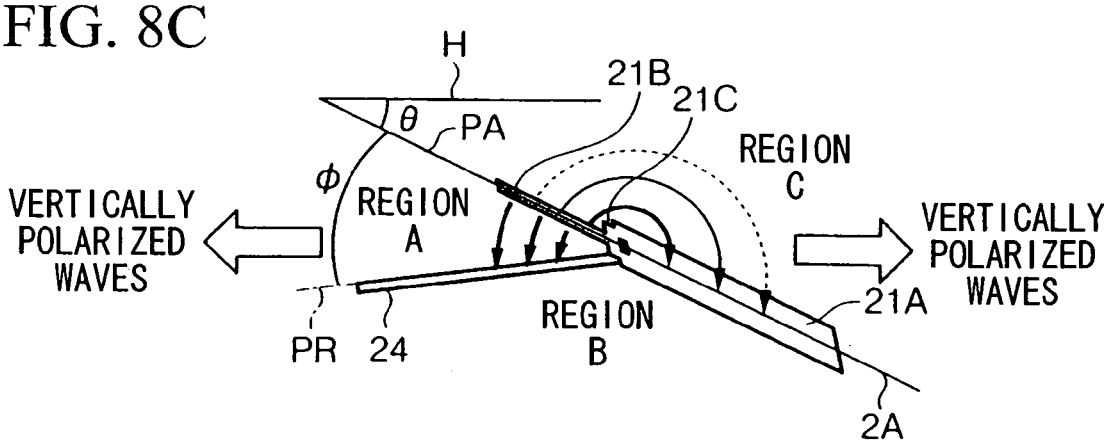
FIG. 8C is a graph showing one example of the electric field distribution of the same vehicle-mounted antenna.

Moreover, as shown, for example, in FIG. 8C, if second conductor section 21B having a different shape than first conductor section 21A is provided so as to form a predetermined angle $\phi$ with electrically conductive reflecting plate 24 in the direction extending upward in the vertical direction (namely, towards the front of the vehicle) of center line PA of first conductor section 21A, transmission and reception sensitivity with respect to vertically polarized wave components propagating from the horizontal direction can be further improved.

Figure 9B:
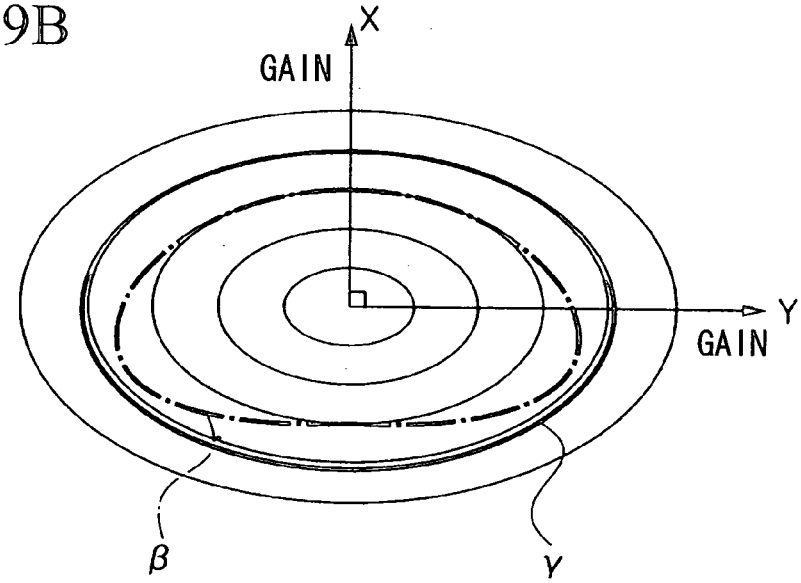
FIG. 9B is a graph showing one example of the directional characteristics with respect to vertically polarized waves in the horizontal plane between the vehicle-mounted antenna shown in FIG. 8B and the vehicle-mounted antenna shown in FIG. 8C.

Namely, in addition to the strength of the electric field of region A, in which the angle formed by electrically conductive reflecting plate 24 and second conductor section 21B is a predetermined angle $\phi$, being further strengthened, and the strength of the electric field of region B, in which the angle formed by electrically conductive reflecting plate 24 and first conductor section 21A is a supplementary angle ($\pi-\phi$) of predetermined angle $\phi$, being further strengthened, the electric field distribution of region C and region A, in which the angle formed by second conductor section 21B and first conductor section 21A is $\pi$ (180°) is formed more preferably. As a result, as shown in, for example, FIG. 9B, in the directional characteristics with respect to vertically polarized wave components within the horizontal plane, directional characteristic $\gamma$ in the case of providing electrically conductive reflecting plate 24 and second conductor section 21B is such that together with gain in all directions within the horizontal plane increasing as compared with direction characteristic $\beta$ in the case of providing only electrically conductive reflecting plate 24, the gain becomes nearly equal in all directions, resulting in a so-called non-directional state.

Figure 10:
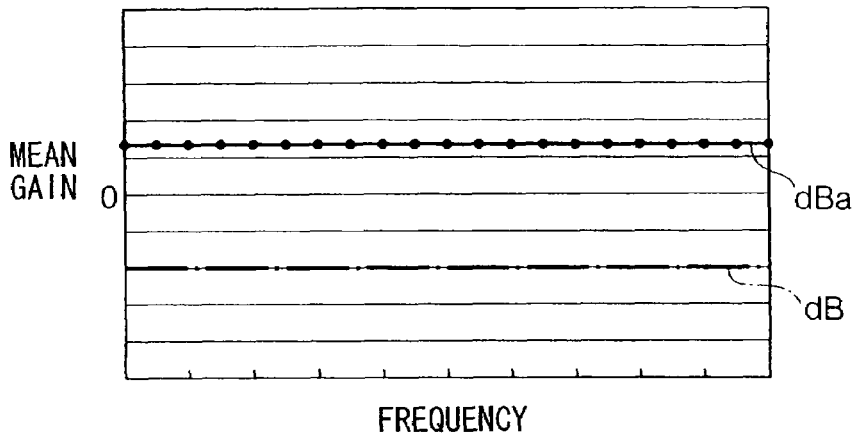
FIG. 10 is a graph showing one example of the change in mean gain versus frequency of the vehicle-mounted antenna shown in FIG. 1.

In addition, as shown, for example, in FIG. 10, a change in the sensitivity, or gain, with respect to vertically polarized wave components of this vehicle-mounted antenna 10 corresponding to the frequency of the mean value (mean gain) dBa around the vertical axis (Z axis shown in FIG. 1), is a value larger than a predetermined lower limit mean gain dB, and this can be understood to make it possible to secure desired transmission and reception sensitivity with respect to vertically polarized wave components.

Figure 11:
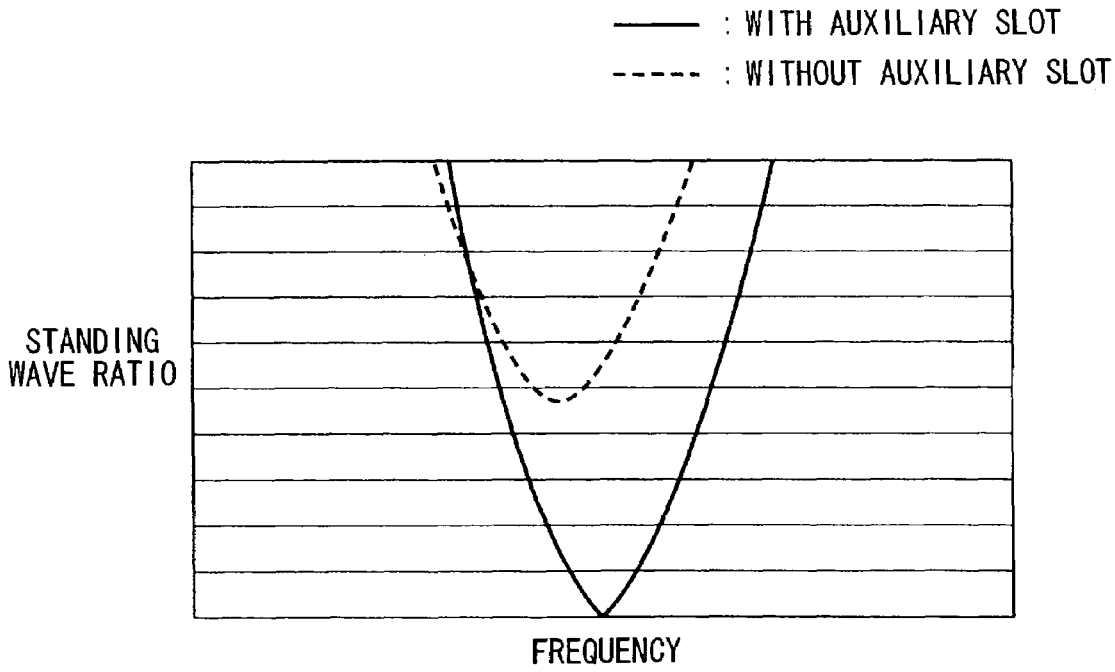
FIG. 11 is a graph showing one example of the change in the standing wave ratio versus frequency in the case of the presence and absence, respectively, of an auxiliary slot in the same vehicle-mounted antenna.

Moreover, as shown, for example, in FIG. 11, as a result of providing auxiliary slot 23 in second conductor section 21B, impedance characteristics are improved as compared with the case of, for example, omitting auxiliary slot 23, and this can be understood to be able to lower the standing wave ratio (SWR).

As has been described above, according to a vehicle-mounted antenna 10 according to the present embodiment, radiation characteristics in the horizontal direction of slot antenna 10*a* can be improved by providing electrically conductive reflecting plate 24, thereby making it possible to improve sensitivity with respect to vertically polarized waves arriving from the horizontal direction.

Moreover, since the size of electrically conductive reflecting plate 24 can be reduced in the state in which a desired transmission and reception sensitivity with respect to vertically polarized waves has been secured, the field of view of vehicle passengers from being obstructed can be prevented, and also impairment of vehicle appearance can be prevented.

Moreover, as a result of giving grounding conductor 21 an asymmetrical shape bordering at the location where slot 22 is formed in grounding conductor 21, as compared with the case of, for example, giving grounding conductor 21 a symmetrical shape, impedance characteristics can be improved, and the transmission and reception sensitivity with respect to vertically polarized waves arriving from the horizontal direction can be improved, and also the directional characteristics with respect to vertically polarized waves arriving from the horizontal direction can be set to have a shape that more closely approaches non-directivity.

Moreover, impedance characteristics can be further improved by forming a roughly U-shaped auxiliary slot in second conductor section 21B, and connecting both ends of auxiliary slot 23 to slot 22.

Furthermore, although the length of second conductor section 21B in the lengthwise direction of slot 22 is formed to be shorter than the length of first conductor section 21A in the aforementioned present embodiment, the present invention is not limited to this, but rather, for example, first conductor section 21A and second conductor section 21B may be formed to have an equal length, and first conductor section 21A and second conductor section 21B may be formed symmetrically with slot 22 being the border between them.

In addition, although center line PA of first conductor section 21A and center line PB of second conductor section 21B were made to be aligned in the lengthwise direction of slot 22 in the aforementioned present embodiment, the present invention is not limited to this, but rather center line PA and center line PB may be, for example, set to be shifted out of alignment in the lengthwise direction of slot 22.

Figure 12:
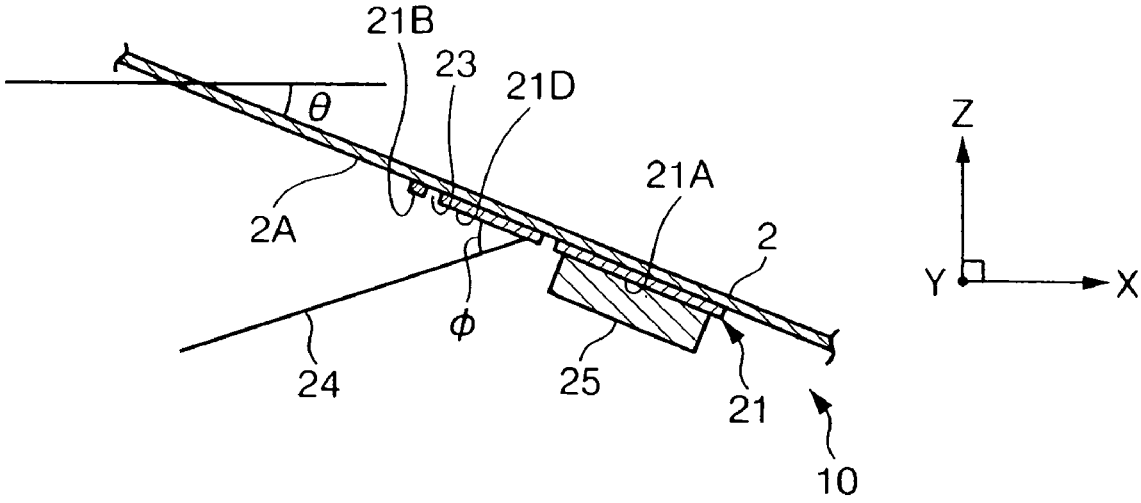
FIG. 12 is a cross-sectional view of a vehicle-mounted antenna according to a variation of the present embodiment.

In addition, although electrically conductive reflecting plate 24 is made to protrude from a location shifted downward in the vertical direction (namely, towards the rear of the vehicle) from slot 22 on the surface of grounding conductor 21 in the aforementioned present embodiment, the present invention is not limited to this, but rather as shown, for example, in FIG. 12, electrically conductive reflecting plate 24 may be arranged so as to protrude from a location shifted upward in the vertical direction (namely, towards the front of the vehicle) from slot 22.

In addition, although center line PR of electrically conductive reflecting plate 24 was made to intersect with center line PA of first conductor section 21A, center line PB of second conductor section 21B and center line PC of border conductor section 21C in the aforementioned present embodiment, the present invention is not limited to this, but rather, for example, center line PR of electrically conductive reflecting plate 24 may be set so as to not intersect each center line PA, PB and PC, but instead contain locations shifted from each center line PC, PB and PC in the lengthwise direction of slot 22.

Moreover, the first conductor section 21A and the second conductor section 21B correspond to "conductor section" described in claim of the present invention, and the conductor 21D corresponds to "another conductor section" described in claim of the present invention.

Although the above has provided an explanation of preferable embodiments of the present invention, the present invention is not limited to these embodiments. The constitution of the present invention may be added, omitted, substituted or altered in other ways provided those alterations are within a range that does not deviate from the gist of the present invention. The present invention is not limited by the aforementioned explanation, and is limited only by the attached scope of claim for patent.

What is claimed is:

1. A vehicle-mounted antenna comprising:

a slot antenna equipped with a grounding conductor provided on the surface of a dielectric substrate and a slot formed in the grounding conductor that exposes the surface of the dielectric substrate; and a plate-shaped electrically conductive reflecting member that protrudes from the surface of the grounding conductor at a location close to the slot and forms a predetermined angle with the surface of the grounding conductor, wherein the grounding conductor is provided inside of a vehicle, and wherein the electrically conductive reflecting member protrudes from the surface of the grounding conductor towards an interior of the vehicle.

2. The vehicle-mounted antenna according to claim 1, wherein the grounding conductor is composed of two conductor sections integrally formed with the location where the slot is formed serving as the border between the two conductor sections, the length of one conductor section in the lengthwise direction of the slot is formed to be shorter than the length of the other conductor section, and the two conductor sections are formed in mutually asymmetrical shapes bordering on the slot, wherein the slot is surrounded on all sides by the grounding conductor.

3. A vehicle-mounted antenna comprising:

a slot antenna equipped with a grounding conductor provided on the surface of a dielectric substrate;

a slot formed in the grounding conductor, the slot exposing the surface of the dielectric substrate; and a plate-shaped electrically conductive reflecting member that protrudes from the surface of the grounding conductor at a location close to the slot and forms a predetermined angle with the surface of the grounding conductor, wherein the grounding conductor is composed of two conductor sections integrally formed with the location where the slot is formed serving as a border between the two conductor sections, the length of one conductor section in the lengthwise direction of the slot is formed to be shorter than the length of the other conductor section, and the two conductor sections are formed into mutually asymmetrical shapes bordering on the slot, wherein the slot is surrounded on all sides by the grounding conductor, wherein the grounding conductor is provided inside of a vehicle, and wherein the electrically conductive reflecting member protrudes from the surface of the grounding conductor towards an interior of the vehicle.

4. The vehicle-mounted antenna according to claim 1, wherein an auxiliary slot is provided in the grounding conductor that exposes the surface of the dielectric substrate roughly in the shape of the letter "U", the slot is connected to both ends of the auxiliary slot, and another conductor section is formed in the grounding conductor of which the peripheries are surrounded by the slot and the auxiliary slot.

* * * * *